US010260289B1

(12) United States Patent
Shepherd

(10) Patent No.: US 10,260,289 B1
(45) Date of Patent: Apr. 16, 2019

(54) DRILLING SYSTEM WITH DRILL BIT FOR MINING MACHINE

(71) Applicant: William L. Shepherd, Montgomery, TX (US)

(72) Inventor: William L. Shepherd, Montgomery, TX (US)

( * ) Notice: Subject to any disclaimer, the term of this patent is extended or adjusted under 35 U.S.C. 154(b) by 0 days.

(21) Appl. No.: 15/874,309

(22) Filed: Jan. 18, 2018

(51) Int. Cl.

| | |
|---|---|
| ***E21B 7/02*** | (2006.01) |
| ***E21B 10/24*** | (2006.01) |
| ***E21B 10/25*** | (2006.01) |
| ***E21B 10/52*** | (2006.01) |
| ***E21B 21/00*** | (2006.01) |
| ***E21B 21/16*** | (2006.01) |

(52) U.S. Cl.
CPC ..... *E21B 10/24* (2013.01); *E21B 7/025* (2013.01); *E21B 10/25* (2013.01); *E21B 21/16* (2013.01); *E21B 10/52* (2013.01); *E21B 2021/005* (2013.01)

(58) Field of Classification Search
CPC .... E21B 10/18; E21B 10/22; E21B 2010/225; E21B 10/24; E21B 10/25
See application file for complete search history.

(56) References Cited

U.S. PATENT DOCUMENTS 1,918,902 A * 7/1933 Fletcher ..... E21B 10/22 175/337
3,151,626 A 10/1964 Everett
3,370,895 A * 2/1968 Cason, Jr. ..... E21B 10/25 277/336
3,401,719 A 9/1968 Rosser
3,847,234 A 11/1974 Schumacher
4,183,417 A * 1/1980 Levefelt ..... E21B 10/18 175/339
4,727,942 A 3/1988 Galle et al.
4,887,675 A 12/1989 Shotwell
5,072,795 A 12/1991 Delgado et al.
5,441,120 A 8/1995 Dysart
5,490,570 A 2/1996 Millsapps, Jr.
5,891,830 A * 4/1999 Koltermann ..... C10M 169/02 175/227
6,196,340 B1 * 3/2001 Jensen ..... E21B 10/52 175/431
6,202,766 B1 3/2001 Shepherd
7,975,782 B2 * 7/2011 Peterson ..... E21B 10/24 175/227

(Continued)

*Primary Examiner* — Blake E Michener
(74) *Attorney, Agent, or Firm* — Buskop Law Group, P.C.; Wendy Buskop

(57) ABSTRACT

A drilling system for a mining machine, the mining machine including a frame and a boom moveable coupled to the frame and a drill string positioned in a blast hole. The system includes an air compressor, a drill bit connected to the air compressor configured to receive low pressure air. The drill bit has a nozzle free drilling body, three sealed rotating cones, each cone with a plurality of cutting elements. Each cone having a sealed bit bearing assembly with diaphragm free lubricant spaces. A single central air conduit in the drilling body providing continuous high flow rate low pressure air from the drill string configured to strike the plurality of outer surfaces of the sealed rotating cones upon exit of the high flow rate low pressurize air from the single central air conduit cooling the sealed bit bearing assemblies. A relief conduit is used.

11 Claims, 3 Drawing Sheets

(56) References Cited

U.S. PATENT DOCUMENTS

| | | | | |
|---|---|---|---|---|
| 8,347,986 | B2 * | 1/2013 | Anderele | E21B 10/24 175/228 |
| 2005/0274549 | A1 * | 12/2005 | Yong | E21B 10/25 175/371 |
| 2006/0006606 | A1 * | 1/2006 | Smith | E21B 10/25 277/500 |
| 2012/0193151 | A1 * | 8/2012 | Harrington | E21B 10/25 175/359 |

* cited by examiner

DRILLING SYSTEM WITH DRILL BIT FOR MINING MACHINE

CROSS-REFERENCE TO RELATED APPLICATIONS

The present application claims priority to U.S. Provisional Patent Application Ser. No. 62/461,430, filed on Feb. 21, 2017, for "DRILLING SYSTEM WITH DRILL BIT FOR MINING MACHINE." This reference is hereby incorporated in their entirety.

FIELD

The present embodiments generally relate to a drilling system for a mining machine.

BACKGROUND

A need exists for a low pressure self-cooling drill bit to automatically cool bearings in sealed rotating cones to increase operating life of the drill bit while improving speed of drilling.

The present embodiments meet these needs.

BRIEF DESCRIPTION OF THE DRAWINGS

The detailed description will be better understood in conjunction with the accompanying drawings as follows.

DETAILED DESCRIPTION OF THE EMBODIMENTS

Figure 1:
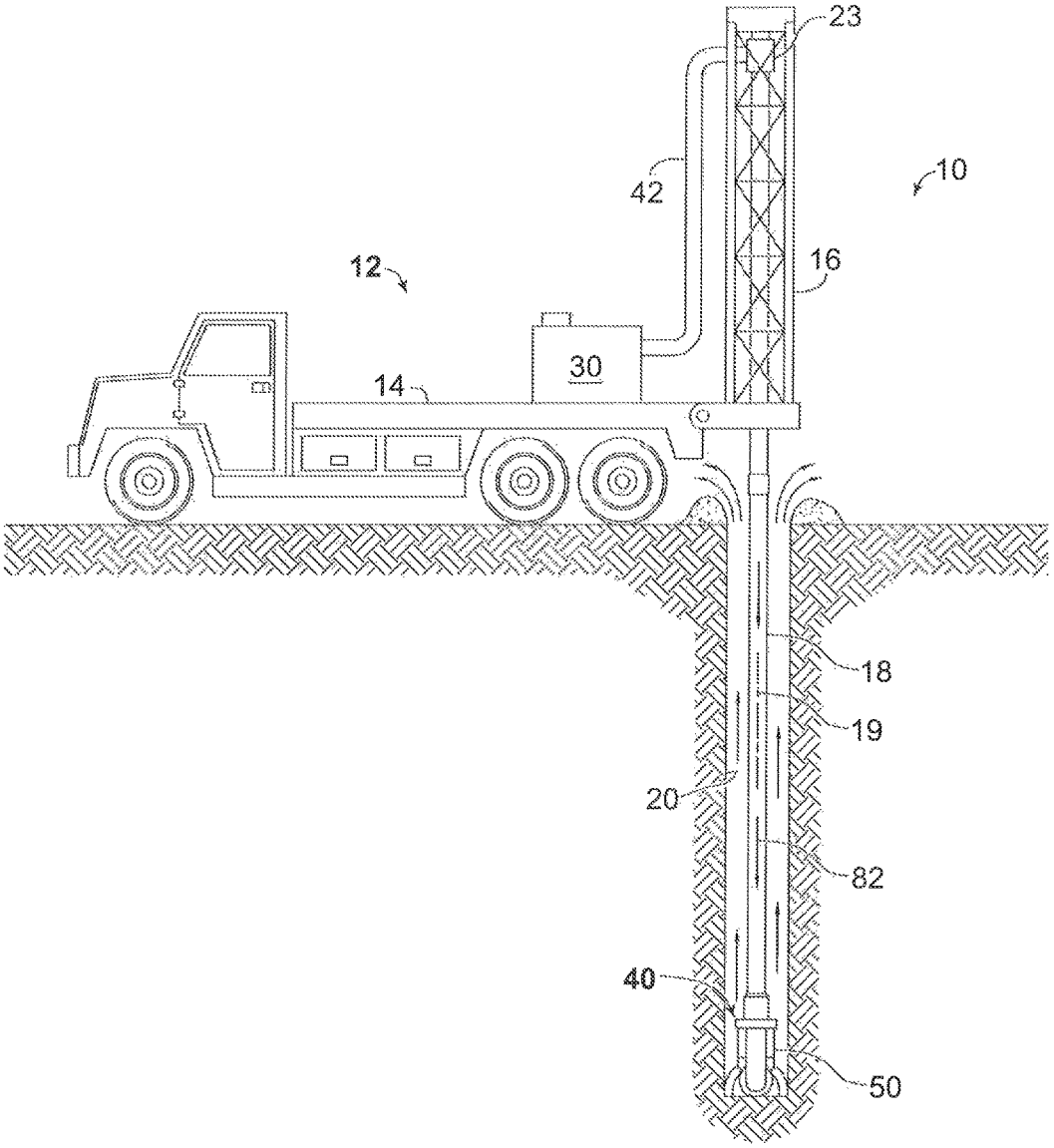
FIG. 1 is perspective view of the drilling system for a mining machine according to one or more embodiments.

Before explaining the present system in detail, it is to be understood that the system is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The sealed bearing mining drill bit of the invention has no need to retain rubber compensators that balance internal and external pressure in lube systems of commercially available drilling bits that are used in deep fluid drilling applications.

Mining blast hole drill bits operate in shallow air drilling applications and depend on air circulation to clean the drilled hole. Downhole pressure is atmospheric pressure only. A seal used in a mining bit does not typically experience a large pressure differential unless it results from heat generated grease expansion in the contained lube system space.

An advantage of the present invention is that is there is no need to retain or use nozzles in the sealed bearing mining bit design. The purpose of the nozzles is to create an internal air pressure in the drilling bit that forces cooled air through the bearing passages. In the present design, there are no air passages for cooling only the central air conduit. There are no nozzles.

The present invention has the advantage of being nozzle free and air passage free for air cooling of the bit bearing assembly with diaphragm free lubricant spaces.

By no longer needing passages for air cooling other than the central air conduit, the hole cleaning air can be circulated through a center opening reducing the required pressure to operate longer and drill faster without breaking and preventing casualties and injuries.

The central air conduit provides about a 50 percent larger air flow area than nozzle connected air passages. The central air conduit results in a reduced load on the air compressor, enabling the air compressor to have a longer operational life.

This drilling bit does not apply air pressure into the formation as in liquid drilling operations.

The present system relates to an drilling system for mining equipment.

An advantage of the invention is that without the three nozzles used in other designs, the nozzle free drilling body has a more aerodynamic bit body design for easier movement in the wellbore, sliding up and down more easily than other designs.

The embodiments eliminate the need for a bit compensator.

This design saves on parts, engineering and assembly time.

A unique relief valve is used herein, which has been patented in owned U.S. Pat. No. 6,202,766 and all of that information is incorporated herein, including the cited references.

The unique relief valve prevents pressure build up due to the heating of the lubrication, in the bit assembly. This construction provides a simplified lubrication/greasing method for workers operating the equipment.

The invention relates to a drilling system for a mining machine, such as for drilling blast holes for copper, silver, iron or removing other rock materials from the earth.

The mining machine can have a mobile frame which can range in size, such as 5 feet to 15 feet. For example the mobile frame can be used for drilling blast holes from 6 and ¼ inches to 12 and ¼ inch.

A boom can be moveably coupled to the frame.

The boom can be up to 50 feet in height.

A drill string can be positioned in an annulus of a blast hole and connected to the boom.

The drilling system can have several connected components.

The drilling system can include an air compressor, which can operate to provide a low pressure air to the drill string. An air compressor such as an ordinary rig based air compressor can be used.

A unique and novel drill bit can be connected to the drill string and fluidly connected to the air compressor.

The drill bit can be configured to receive pressurized air from the compressor at a low flow rate, such as between 1 and 3 cubic feet per minute.

The pressurized air can flow into the drill string at a psi from 25 psi to 1 atm.

The drill bit can have a unique structure that includes a nozzle free drilling body engaging the drill string and receiving the air from the compressor.

The nozzle free drilling body can have a plurality of lubrication passages for holding lubrication such as grease in the bearing spaces of the rotating cones of the nozzle free drilling body.

In embodiments, the each rotating cone can hold from 1 ounces to 16 ounces of specialized heat resistant grease.

The nozzle free drilling body can have threads cut into the drilling body enabling threading to the drill string and threading to receive a relief valve.

The drilling body can have three sealed rotating cones for cutting into the earth.

Each sealed rotating cone can have a plurality of cutting elements pressed or otherwise installed in the cone and slightly projecting from the surface of each cone.

Each cutting element can project from one-fourth inch to 1 inches from a surface of each rotating cone.

Each cutting element can have a special shape, such as conical or spherical for enabling drill cuttings to flow away from the sealed rotating cone.

Between three and 20 cutting elements can be used on each cone.

Each sealed rotating cone can be mounted in the nozzle free drilling body. All projecting portions of the sealed rotating cone can point in the same direction from the drill body to project away from the drill body.

Each sealed rotating cone can have a cone bearing and a bit leg bearing.

When the two bearings are connected together in the sealed rotating cone, the connected bearings can form a bit bearing assembly with diaphragm free lubricant spaces.

Each sealed rotating cone can have a seal to prevent lubrication, such as grease, from leaking from the sealed rotating cone into the blast hole.

Each sealed rotating cone can be configured to engage a rock formation while rotating about a central axis of the drill string.

Each sealed rotating cone can rotate about a drill bit axis.

In embodiments, each sealed rotating cone can have a ball bearing race for containing a plurality of ball bearings and a plug that contains the ball bearings in the ball bearing race enabling cone retention to the drill bit body.

The nozzle free drilling body can also have a single central air conduit formed longitudinally through the nozzle free drilling body in parallel with the drill string axis.

The single central air conduit can receive low pressurize air from the drill string and flow the air from the drill string to strike simultaneously the three cone outer surfaces to cool the bearings within the cones and keep the bearings at a low temperature In embodiments, the continuous low pressure air can be oriented to impact each sealed rotating cone at an angle tangent to a plane on the outer surface of each sealed rotating cone.

The single central air conduit can have a diameter that does not connect with other channels and openings of the drilling body, such as the lubrication spaces or the ball bearing races within the nozzle free drilling body.

The single central air conduit can extend longitudinally and in-line with the central axis of the drill string. The single central air conduit can provide continuous low pressure high flow air from the drill string configured to strike a plurality of outer surfaces of the sealed rotating cones upon exit of the pressurized air from the single central air conduit to cool the bit bearing assembly with diaphragm free lubricant spaces.

A plurality of rubber seals can be used in the nozzle free drilling body. One rubber seal can be used per cone, and a relief valve installed in the nozzle free drilling body also has a rubber seal.

Each rubber seal can be used inside a sealed rotating cone to providing a barrier to contain lubrication in the bit bearing assembly with diaphragm free lubricant spaces.

Each rubber seal can be configured to handle small differential pressures between the lubrication and drilling debris flowing out of the drill string annulus.

In embodiments, each rubber seal can be a high temperature resistant and heat resistant elastomeric o-ring that is compressed by the bit bearing assembly.

A relief conduit can be drilled or cut in the drilling body.

The relief conduit can provide fluid communication between the diaphragm free lubricant spaces and the bit bearing assembly to prevent high pressure buildup of lubrication in the bit bearing assembly.

A relief valve as described in U.S. Pat. No. 6,202,766 which content is fully incorporated herein, is secured into the relief conduit such as by threading, to provide a leak tight connection.

The drilling system can operate such that when the single central air conduit free of nozzles provides a pressurized air flow impacting into the plurality of sealed rotating cones, the air flow reduces heat buildup at the same rate of temperature reduction as a high pressure air flow with nozzles but requiring less load on the air compressor.

In embodiments, the relief valve can actuates when lubrication pressures in the sealed rotating cones exceed pressures of 130 psi.

The relief valve can be set to operate and provide pressure relief at any pressure between 50 psi and 130 psi, including all the numbers in between.

In embodiments, a dust control agent can be premixed with the pressurized air at a low flow rate and used herein. The dust control agent can be water or glycol.

Reducing or eliminating dust that results from tradition bit drilling methods is desirable and in some areas dust control is mandated by government regulations.

Water injection is not desirable in open bearing systems. However, this system avoids the problems caused by water injection in that the bearings are sealed within the rotating cones, enabling longer life operation for the drill bit.

Water injection can provide a negative impact on open bearing bit life. A sealed bit does not present the same problems, because there is no direct contact to the bearing elements by the injected water. In the case of sealed bit bearing assemblies, the use of water to control dust is desired because water also provides a cooling effect. Water in the amount of 10 percent to 25 percent of the quantity of the combined air and water stream can be used herein.

The following definitions are used herein:

The term "air compressor" refers to a motorized device that produces pressurized air from 80 psi to 90 psi that is fluidly connected to the boom for providing pressurized air in the bore hole.

The term "bit bearing assembly with diaphragm free lubricant spaces" refers to a rubber sealed and greased journal bearing and ball bearing which extends the life of the drill bit used in mining bit systems. The rubber sealed bearing system prevents bearing wear so the design geometry of the bit cutting structure is maintained through the full life of the drill bit resulting in smoother, longer lasting product.

The term "boom" refers to a steel structure similar to a derrick or a tower made from heavy duty pipe and attached to the frame, preferably in a hinged manner enabling the boom to lay flat during transit.

The term "bore hole" refers to a hole in the earth dug by the novel and inventive drill bit.

The term "cool" as used herein can refer to a drop in temperature from an initial temperature before air impact on the sealed rotating cones from 15 degrees Fahrenheit to 150 degrees Fahrenheit.

The term "cutting elements" refer to a plurality of inserted diamond compact inserts which project slightly from the surface of each sealed rotating cone, from 1 mm to 3 mm from the surface of each sealed rotating cone. In embodiments, the cutting elements are inserted into drilled holes formed on the outside of the sealed rotating cone. The density of the cutting elements can be from 10 to 50 per sealed rotating cone, having a diameter of from 1 mm to 2 mm. Each cutting element is contemplated to be a tapered cutting element, tatter near the surface of the sealed rotating cone and tapering to a flat face.

The term "cutting inserts" refers to wear resistant grades of material, which can be made from carbide, tungsten carbide, or polycrystalline diamond compacts. In embodiments, all or a portion of the cutting inserts can include a coating or plating to improve drill bit cutting.

The term "drill bit" refers to a tool for digging a bore hole with a nozzle free drilling body.

The term "drill string" refers to connected pipe formed from steel running down hole and supported by the boom.

The term "frame" can be the bed of a truck including a drilling fluid conduit to receive fluid from a wellbore.

The term "mining machine" refers to an machine for extracting minerals.

The term "nozzle free drilling body" has a bit shank with threads on the exterior with a conduit through the shank longitudinally oriented in paralled with the drill string without any nozzles. The nozzle free drilling body typically has three legs surrounding the conduit through the shank opposite the portion of the shank with the exterior threads. The drill string screws onto the nozzle free drilling body.

The term "relief valves" refers to valves, which are substantially about the size of a one-eighth inch pipe each having a rubber element ensuring lubrication pressure over 95 psi, keeping high pressure off the seals, preventing fluid in the rock bit rising. The relief valves are used to reduce heat build up on the nozzle free drilling body by reducing pressure systematically. By keeping pressure down, temperatures are reduced in the nozzle free drill bit body.

The term "rubber seal" as used herein specifically excludes diaphragms and can be o-rings. The rubber seal are not flat seals and always o-rings having a thickness of three-sixteenths to one-fourth inch. The rubber seal is only of the type that seals against differential pressures between 70 psi to 100 psi, such as from 80 to 90 psi.

The term "sealed rotating cone" is the cutting structure for the drill bit. Each sealed rotating cone is attached to a leg. Each sealed rotating cone rotates so as to no cause friction build up with another cone, but rotates within close proximity to the other cones. The compressor generates air that turns the sealed rotating cones causing the sealed rotating cones to cut dirt.

The term "single central air conduit" refers to a passage formed through the nozzle free drilling body in line with the central axis of the drill string. The single central air conduit provides continuous low pressure high flow air from the compressor at a psi from 50 psi to 90 psi. The single central air conduit tapers outwardly from the bit shank towards the legs. The angle of the taper can be from 15 degrees to 30 degrees from the central axis, such as 20 degrees.

Turning now to the Figures, FIG. 1 is perspective view of the drilling system for a mining machine.

A drilling system 10 for a mining machine is depicted.

The mining machine 12 includes: a frame 14 and a boom 16 moveably coupled to the frame 14. A rotary head 23 is connected to the boom 16 to hold and rotate a drill string interior of the boom.

The rotary head 23 can be connected to a drill string 18 with a central axis 19. The drill string can be positioned in a bore hole 20 or create a bore hole using the novel drill bit attached to the drill string.

An air compressor 30 can be mounted on the frame 14.

A drill bit 40 can be screwed to the drill string 18 and receive compressed air through the drill string 18 from the air compressor 30.

The drill bit 40 is configured to receive pressurized air 42, which turns sealed rotating cones attached to a nozzle free drilling body 50.

The nozzle free drilling body 50 can engage the drill string 18.

Figure 2:
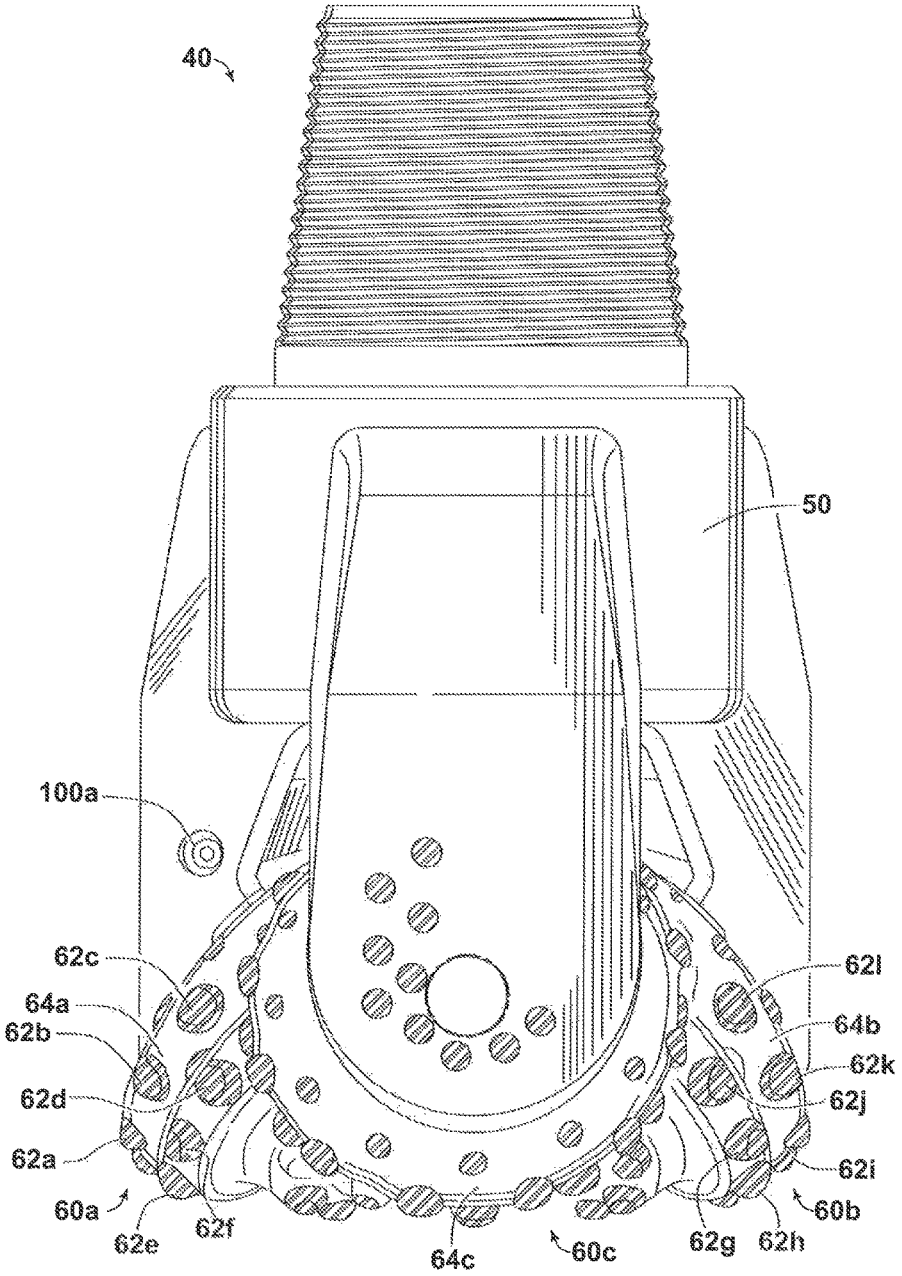
FIG. 2 a detailed view of the three rotating cones and the drill body according to one or more embodiments.

FIG. 2 shows the drill bit 40 with nozzle free drilling body 50.

The drill bit 40 can have three sealed rotating cones 60*a*-60*c*.

Each sealed rotating cone 60*a*-60*c* can have a plurality of cutting elements 62*a*-62*g* projecting from a surface 64*a*-64*c* of each sealed rotating cone. The cutting elements can be compact diamond inserts or tungsten carbide. Other cutting elements can be made from 100 percent tungsten carbide.

A relief valve 100*a* is depicted engaging the nozzle free drilling body 50.

Each sealed rotating cone 60*a*-60*c* can be mounted in the nozzle free drilling body 50. Each sealed rotating cone can weigh 10 pounds to 15 pounds up to 100 pounds/120 pounds.

Figure 3:
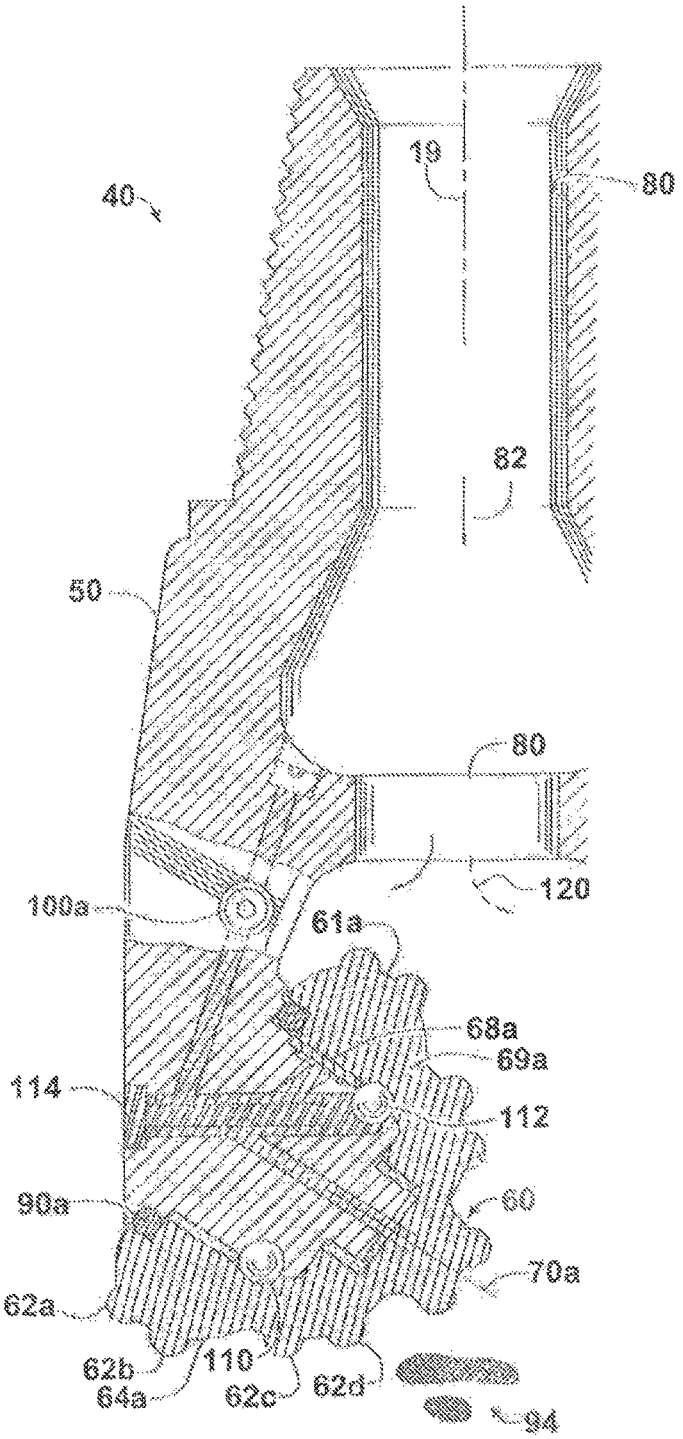
FIG. 3 is a cross section view of a drill bit according to one or more embodiments.

FIG. 3 shows that one of the sealed rotating cone 60*a* can have a cone bearing and a bit leg bearing 68*a* forming a bit bearing assembly with diaphragm free lubricant spaces. The sealed rotating cone 60*a* can have the surface 64*a* and cutting elements 62*a* and 62*b*.

Lubricant usable in the lubricant space can be a commercially available drill bit lubricant, preferably heat resistant grease.

Each sealed rotating cone can be configured to engage a rock formation while rotating about the central axis 19 of the drill string. Each sealed rotating cone also rotates about a drill bit axis, drill bit axis 70*a* is labelled.

A single central air conduit 80 can be formed through the nozzle free drilling body 50.

The single central air conduit can extend longitudinally and in-line with the central axis 19 of the drill string.

The single central air conduit 80 can provide continuous low pressure high flow air 82 from the drill string.

The continuous low pressure high flow air 82 can be configured to strike each outer surface of the plurality of sealed rotary cones.

Outer surface 61*a* is shown.

Debris can rise up the bore hole on the outer surface of the drill bit and the debris can fall on the ground external of the bore hole.

Upon exit from the single central air conduit, the low pressure air can cool the bit bearing assembly with diaphragm free lubricant spaces 69*a* and the other bit bearing assemblies in the other rotating cones not shown.

A plurality of rubber seals can be used, rubber seal 90*a* is shown. The diameter of each rubber seal can be from 2 inches to 3 inches in diameter.

Each rubber seal 90*a* can provide a barrier to contain lubrication 92 in the diaphragm free lubricant spaces of the bit bearing assembly.

Each rubber seal can be configured to handle small differential pressures between the lubrication 92 and drilling debris 94.

A plurality of relief valves can be used one per sealed rotating cone. Pressure relief valve 100*a* is labelled.

Each pressure relief valve 100*a* can have a "rubber element" ensuring lubrication pressure relief over 150 psi. This rubber element does not act as a diaphragm in the way diaphragms are used in the lubrication system of drill bits that drill deep into a wellbore over 50 feet.

Each sealed rotating cone 60*a* can be depicted having a ball bearing race 110 for containing a plurality of ball bearings 112 and a plug 114.

The ball bearing race 110 can contain the ball bearings enabling sealed rotating cone retention to the nozzle free drilling body. The balls can hold the bearing onto the drill bit body. The bearings can be two sleeves. The legs can have two holes that receive the ball of the ball bearing to hold the sleeves to the legs. The holes can be filled up after the ball is inserted, and do not carry a load and present the sealed rotating cone from falling off the legs to which the sealed rotating cone is attached.

Each sealed rotating cone can rotate about a drill bit axis, one of the drill bit axis 70*a* is labelled.

A dust control agent 120 can be mixed in the pressurized air 42 so that the mixture can flow at a low flow rate for additional cooling of the bit bearing assembly with diaphragm free lubricant spaces.

For example, a 7 and ⅞$^{th}$ inch IADC 637A bit was run as a test at a coal mine in West Virginia.

While the bit was used with air pressure running at 30 psi and improved bit performance was observed, producing more drill cuttings with no increase in production cost.

There was no observed bearing wear during a 3 day test and the cutting structure geometry stayed intact, allowing the drill bit to run down hole smoother through its life while maintaining hole diameter.

The drill bit operated without nozzles at a lower air differential pressure lowering the load on the rig compressor which would extend the compressor life.

The test bit was compared to data produced under identical conditions to commercially equivalent bits, namely, a 7 and ⅞ inch Mag™ 62 bit and a DF™ 70 bit.

All bits were run to 2000 foot depths down hole.

The Weight on Bit for the rig for each bit was 29000 pounds.

The applicants test footage was 2600 feet with a penetration rate of 113 Ft/hr using a rotary speed of 85 rpm.

Compared to the other commercially available bits that ran air compressors at higher load, producing 50 percent more heat for the same test, the applicants bit showed its condition was not significantly dulled and had effective seal life remaining with no grease loss. Applicants gage wear was measured at 0.175 inches which was less wear than the commercially similar drill bits by 0.2 inches.

While these embodiments have been described with emphasis on the embodiments, it should be understood that within the scope of the appended claims, the embodiments might be practiced other than as specifically described herein.

What is claimed is:

1. A drilling system for a mining machine, the mining machine including: a frame and a boom moveably coupled to the frame, a rotary head connected to the boom for supporting and turning a drill string with a central axis positioned to creates a bore hole in the earth, the drilling system comprising:

a. an air compressor;

b. a drill bit connected to the air compressor, the drill bit configured to receive pressurized air, the drill bit consisting of:

i. a single central air conduit drilling body engaging the drill string;

ii. three sealed rotating cones, each sealed rotating cone having a plurality of cutting elements projecting from a surface of each sealed rotating cone; each sealed rotating cone mounted in the nozzle free drilling body, each sealed rotating cone consisting of a cone bearing and a bit leg bearing forming a bit bearing assembly, each bit bearing assembly with a lubricant space excluding a diaphragm, each sealed rotating cone configured to engage a rock formation while rotating about the central axis of the drill string, each sealed rotating cone rotating about a drill bit axis;

iii. a single central air conduit formed through the single central air conduit drilling body, the single central air conduit extending longitudinally and in line with the central axis of the drill string, the single central air conduit providing continuous low pressure high flow air of from 30 psi to 150 psi, from the drill string, the continuous low pressure high flow air configured to strike outer surfaces of the sealed rotating cones upon exit from the single central air conduit to cool the bit bearing assembly with the diaphragm free lubricant spaces;

iv. a plurality of rubber seals, each rubber seal providing a barrier to contain lubrication in the bit bearing assembly with the diaphragm free lubricant spaces; each rubber seal configured to handle small differential pressures of from 70 psi to 100 psi between the lubrication and drilling debris, the lubricant spaces excluding a separate sealed reservoir and a liquid pressure compensation system; and v. a plurality of air pressure relief valves having a rubber element ensuring pressure relief when pressure exceeds 95 psi, each air pressure relief valve fluidly connected to a respective one of the bit bearing assemblies with the lubricant space excluding a diaphragm; and wherein the single central air conduit, without nozzles, provides a low pressure air flow onto the sealed rotating cones while reducing heat buildup.

2. The drilling system of claim 1, wherein the nozzle free drilling body is threaded to receive the relief valve.

3. The drilling system of claim 1, wherein each cone bearing has a ball bearing race for containing a plurality of ball bearings and a plug, the ball bearing race containing the ball bearings enabling cone retention to the nozzle free drilling body.

4. The drilling system of claim 1, wherein the continuous low pressure high flow air is at a pressure from 14.7 to 25 psi.

5. The drilling system of claim 1, comprising a dust control agent mixed in the pressurized air.

6. The drilling system of claim 5, wherein the dust control agent is water or glycol or combinations thereof.

7. The drilling system of claim 1, wherein the lubrication is a grease that remains a fluid at a temperature from −60 degrees Fahrenheit to 120 degrees Fahrenheit.

8. The drilling system of claim 1, wherein each rubber seal is a hydrogenated nitrile butadiene rubber o-ring.

9. The drilling system of claim 1, wherein the relief valve actuates when lubrication in the diaphragm free spaces heat up and expand increasing pressures to over 130 psi.

10. The drilling system of claim 1, wherein the cutting elements are tungsten carbide or polycrystalline diamond compacts.

11. The drilling system of claim 1 comprising three relief conduits, each relief conduit formed in each bit leg bearing, each relief conduit fluidly connecting a respective one of the lubricant space excluding a diaphragm to the respective relief valve.

* * * * *